United States Patent [19]

Dallaire

[11] 4,088,056

[45] May 9, 1978

[54] GAS INITIATED CARTRIDGES

[75] Inventor: Jean Guy Dallaire, Loretteville, Canada

[73] Assignee: Her Majesty the Queen in right of Canada, as represented by the Minister of Defence, Canada

[21] Appl. No.: 741,487

[22] Filed: Nov. 12, 1976

[30] Foreign Application Priority Data

Jan. 20, 1976 Canada ..... 243833

[51] Int. Cl.[2] ..... F41F 3/02; F41F 15/00

[52] U.S. Cl. ..... 89/1.7; 89/29; 102/41

[58] Field of Search ..... 89/1.7, 1.701, 1.702, 89/8, 29; 42/77; 102/41

[56] References Cited

U.S. PATENT DOCUMENTS

| | | | |
|---|---|---|---|
| 2,360,217 | 10/1944 | Francis | 89/8 X |
| 2,397,800 | 4/1946 | McArthur | 89/8 |
| 2,541,025 | 2/1951 | Bluford et al. | 89/29 |
| 2,648,257 | 8/1953 | Stanley | 89/8 |
| 3,296,928 | 1/1967 | Lübbers | 89/1.701 |
| 3,638,571 | 2/1972 | Gawlick et al. | 102/41 |

FOREIGN PATENT DOCUMENTS

| | | | |
|---|---|---|---|
| 711,043 | 6/1965 | Canada | 102/41 |
| 593,583 | 5/1925 | France | 89/8 |
| 583,174 | 8/1933 | Germany | 89/8 |
| 707,367 | 4/1954 | United Kingdom | 89/29 |
| 757,195 | 9/1956 | United Kingdom | 102/41 |

*Primary Examiner*—David H. Brown
*Attorney, Agent, or Firm*—D. Paul Weaver

[57] ABSTRACT

Initiation of a cartridge in the chamber of a firearm is achieved by providing a port in the chamber through which high pressure gas from a firearm barrel strikes the primer of the cartridge and activates the primer. In one form, the gas driving a projectile through the barrel initiates a plurality of secondary cartridges.

1 Claim, 2 Drawing Figures

GAS INITIATED CARTRIDGES

The present invention relates to the field of firearms and in particular to a technique for initiating discharge of a cartridge.

The conventional and well known technique for firing or intiating cartridges in firearms is to strike the primer of the cartridge with a firing pin, which dents the primer, causing ignition of the priming mixture contained in the primer, which in turn ignites the powder contained in the cartridge.

In contrast, in this invention the propellant gas driving a projectile in a barrel is diverted to a port located at the base of the cartridge chamber, the gas pressure striking the primer of the cartridge located in the chamber and causing discharge of the cartridge.

In one aspect of the present invention, a firearm is provided with a primary and a secondary cartridge, and the secondary cartridge is fired by the gas pressure behind the projectile of the primary cartridge on firing of the primary cartridge. This initiation of the secondary cartridge is accomplished by providing a gas passage, one end of which communicates with the barrel in which the projectile is propelled, and the other end terminating in a port in the chamber containing the secondary cartridge, with the primer of the secondary cartridge being located immediately against the port. Gas pressure from the barrel on firing of the primary cartridge initiates discharge of the secondary cartridge by directly striking and deforming the primer of the secondary cartridge without employing a firing pin.

Figure 1:
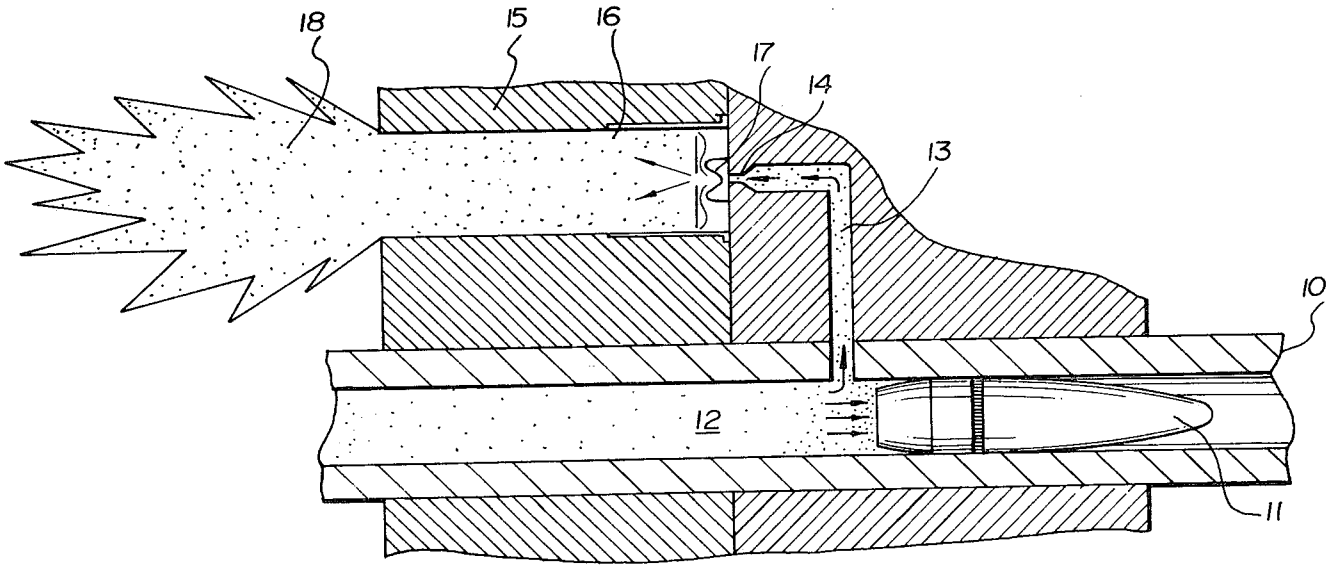
Figure 2:
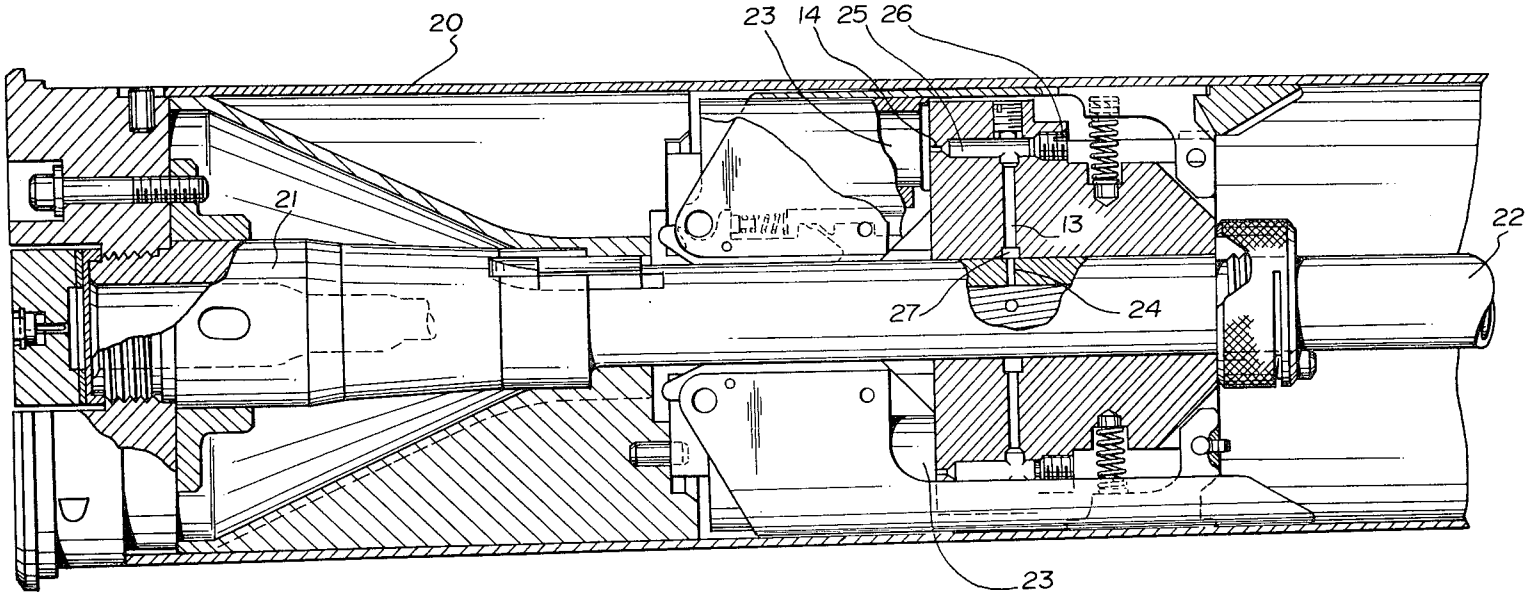

In the accompanying drawings which illustrate the operation of the apparatus pursuant to the present invention and an embodiment thereof, FIG. 1 is a drawing partially schematic illustrating the principal of the present invention, and FIG. 2 is a specific embodiment illustrating a back-blast simulation cartridge for use in a large recoilless rifle.

Referring to FIG. 1 there is shown in cross-section, a barrel 10 down with a projectile 11 is being propelled by gas 12 generated from the burning of powder in a cartridge (not shown). A passage 13 is connected to the barrel 10 and terminates in a port 14 located centrally of the base of the chamber 15 containing a secondary cartridge 16. Gas 12 under a high pressure, frequently as high as 50,000 p.s.i, for example, passing through the passage 13 and reaching the port 14 strikes the primer 17 of a blank cartridge 16 initiating discharge of the cartridge 16 illustrated schematically at 18.

Similar apparatus containing a firing pin actuated by the gas 12 was constructed but failed to operate satisfactorily because of propellant debris and carbon fouling and jamming of the firing pin. It was discovered that by removal of the firing pin and providing a port through which the gas could impinge directly upon the primer of the secondary cartridge, reliable operation occurred without encountering the hazards of jammed firing pins causing non-firing or premature firing of the secondary cartridge on loading into the chamber.

In FIG. 2 there is illustrated a sub-calibre simulation cartridge for a recoilless rifle. Such sub-calibre simulation cartridge includes a cartridge casing 20 of the calibre of the recoilless rifle, in which is fitted a chamber 21 connected to a barrel 22 for firing a sub-calibre projectile within the barrel of the recoilless rifle. Spaced equally around the sub-calibre barrel 22 are four secondary chambers 23 which are hinged to the cartridge casing 20 to permit the loading of blank shot-gun shells into the chambers 23. Four holes 24 are provided in the barrel 22, each hole 24 being connected to a passage 13 through an annular cavity 27 which in turn connects to a bore 25 which terminates in a port 14. Threaded plugs 26 close the ends of passage 13 and bore 25 providing a sealed communication between the bore of barrel 22 and the port 14. When a primary cartridge is loaded into chamber 21 and secondary backblast cartridges are loaded into chambers 23, firing of a projectile from chamber 21 will cause a body of high-pressure gas to be located behind the projectile as it proceeds down the barrel 22. Once the projectile has passed the openings 24, the gas will travel via the passage 13 and the bore 25 to the port 14 of each of the chambers 23 to initiate discharge of the secondary cartridges located in these chambers. The secondary cartridges provide a back-blast simulation for the sub-calibre simulation cartridge 20, thereby enabling a large weapon to be used for training purposes employing small calibre ammunition, resulting in a substantial saving over the cost of firing the fullsized projectiles. Further, wear and tear on the large weapon is avoided since the barrels of such weapons are capable of withstanding only a limited number of firings before they must be replaced.

After the primary cartridge in the chamber 21 and the secondary cartridges in the chambers 23 have been fired, the casing 20 can be ejected from the large weapon and chambers 21 and 23 reloaded for further firing.

It should be noted that in the present invention gas pressure from the barrel is used directly without firing pins to initiate the cartridge primers and fire the cartridges located in the chambers 23. It is believed that the direct application of a gas pressure applied at a high rate to initiate a cartridge primer by deforming or denting the primer is novel and has not previously been used in a weapon of any sort.

The embodiments of the invention in which an exclusive property or privilege is claimed are defined as follows:

1. A sub-calibre back-blast simulation cartridge for a recoiless rifle, comprising a cartridge casing of the calibre of the recoiless rifle in which is fitted a first chamber for receiving a primary cartridge containing a projectile, said chamber being connected to a sub-calibre barrel, a second chamber for receiving a secondary blank cartridge, a passage communicating between said barrel and said secondary chamber, said second chamber having a port therein connected to said passage, said port being positioned to be adjacent the primer of said secondary cartridge when said blank secondary cartridge is in said secondary chamber, whereby gases from said barrel caused by discharge of said primary cartridge directly impinge on and cause deformation of the primer of said secondary cartridge to initiate discharge thereof providing a back-blast simulation.

* * * * *